US011411363B2

(12) United States Patent
Bossuyt et al.

(10) Patent No.: US 11,411,363 B2
(45) Date of Patent: Aug. 9, 2022

(54) METHOD FOR MANUFACTURING AN ELECTRICAL CONTACT

(71) Applicant: Aptiv Technologies Limited, St. Michael (BB)

(72) Inventors: Sylvain Bossuyt, Boutigny-Prouais (FR); François Cormier, Dammarie-sur-Loing (FR)

(73) Assignee: Aptiv Technologies Limited, St. Michael (BB)

( * ) Notice: Subject to any disclaimer, the term of this patent is extended or adjusted under 35 U.S.C. 154(b) by 0 days.

(21) Appl. No.: 17/061,524

(22) Filed: Oct. 1, 2020

(65) Prior Publication Data

US 2021/0104858 A1 Apr. 8, 2021

(30) Foreign Application Priority Data

Oct. 4, 2019 (FR) ..... 1911043

(51) Int. Cl.
*H01R 43/16* (2006.01)
*H01R 43/048* (2006.01)

(52) U.S. Cl.
CPC ..... *H01R 43/16* (2013.01); *H01R 43/048* (2013.01)

(58) Field of Classification Search
CPC ..... H01R 43/16; H01R 43/04; H01R 43/048; H01R 43/26; Y10T 29/49204; Y10T 29/49218
USPC ..... 29/874, 882
See application file for complete search history.

(56) References Cited

U.S. PATENT DOCUMENTS

| | | | | |
|---|---|---|---|---|
| 5,951,338 | A * | 9/1999 | Seko | H01R 13/18 439/843 |
| 6,325,680 | B1 * | 12/2001 | Suzuki | H01R 13/432 439/852 |
| 6,572,418 | B2 * | 6/2003 | Takaya | H01R 4/363 439/812 |
| 7,140,927 | B2 * | 11/2006 | Casses | H01R 13/113 439/852 |
| 9,153,879 | B2 | 10/2015 | Frimmersdorf et al. | |
| 2002/0081914 | A1 | 6/2002 | Takaya et al. | |
| 2015/0275952 | A1 | 10/2015 | Stepper | |

FOREIGN PATENT DOCUMENTS

| | | |
|---|---|---|
| EP | 1113532 | 7/2001 |
| WO | 2012069499 | 5/2012 |

* cited by examiner

*Primary Examiner* — Donghai D Nguyen
(74) *Attorney, Agent, or Firm* — Colby Nipper PLLC

(57) ABSTRACT

Electrical contact for an electrical connector, produced by cutting and bending at least one strip of electrically conducting material. This electrical contact comprises a first wall itself comprising an edge that is adjacent to an edge of a second wall. The first wall has at least one cutout, open onto the edge of the first wall. The second wall has at least one tooth projecting from the edge of the second wall. The tooth is forcibly inserted into the cutout and extends in the plane of the first wall.

9 Claims, 3 Drawing Sheets

METHOD FOR MANUFACTURING AN ELECTRICAL CONTACT

CROSS-REFERENCE TO RELATED APPLICATION

This application claims priority to French Patent Application Number 1911043, filed Oct. 4, 2019, the disclosure of which is hereby incorporated by reference in its entirety herein.

TECHNICAL FIELD

The disclosure relates to the field of electrical contacts or terminals. The disclosure relates more particularly for example to electrical contacts intended to be housed in connectors used in motor vehicles.

BACKGROUND

For electrical connections in motor vehicles, it is common practice to use male and female contacts produced from a strip of electrically conducting material (a copper alloy for example) which is cut by pressing and bent. These male and female contacts are then mounted in connector housings made of electrically insulating plastic.

Thus, for example, starting from a strip of conducting material, it is possible to produce an electrical contact for a female electrical connector, as described in patent U.S. Pat. No. 9,153,879B2, patent application EP1113532A2, patent application WO2012069499A1 or patent application US20150275952 A1. Those documents propose various solutions for, after bending a blank, attaching the respective edges of two constituent walls of a contact to one another. These solutions rely on the insertion of a tooth formed from one wall into a cutout formed in an adjacent wall.

In certain cases, the robustness of the attachment achieved between the walls using this type of solution may prove insufficient. Such is the case, for example, where there is a desire to miniaturize the contact and therefore use a strip of relatively small thickness. Such may also be the case when the configuration of the contact is such that the portion for attachment between the respective edges of two walls is situated in a zone in which the stresses are high, such as for example when the attachment portion is close to a locking tab.

FIG. 1 depicts a solution of the prior art (such as, for example, the prior art mentioned in patent application US20150275952 A1) in which the attachment is reinforced by a laser spot weld 100. More particularly, FIG. 1 schematically depicts the connection portion 2 of an electrical contact 1 for an electrical connector. This contact 1 is produced by cutting and bending at least one strip of electrically conducting material. It comprises a first wall 9 and a second wall 7 which are cut from the strip. The first wall 9 extends essentially in a first plane. The second wall 7 extends essentially in a second plane, distinct from the first plane. The first wall 9 comprises an edge 26 that is adjacent, over at least an attachment portion, to an edge 15 of the second wall 7. The first wall 9 has at least one cutout 13, open onto the edge of the first wall 9, at the level of the attachment portion. The second wall 7 has at least one tooth 13 projecting from the edge 15 of the second wall 7, at the level of the attachment portion. The tooth 14 is inserted into the cutout 13 and a laser spot weld 100 is performed to weld the first 9 and second 7 walls together at the level of the attachment portion.

This type of solution which is reinforced using a spot weld generally proves satisfactory. However, laser welding has disadvantages: it requires investment in specific equipment and occupies a greater amount of space on account of the presence of such equipment, it slows the method of manufacture of the contact, etc.

SUMMARY

It is an object of the techniques of this disclosure to at least partially alleviate the disadvantages mentioned above with respect to prior art. What is proposed is a contact of the type described above in connection with FIG. 1, but in which there is no spot weld. By contrast, in the proposed contact, the tooth is forcibly inserted into the cutout while extending in the plane of the first wall. In other words, on the one hand, the tooth is wedged into the cutout into which it is inserted and, on the other hand, the fact that the tooth extends in the same plane as the first wall means that the zones of interaction between the tooth and the cutout can be optimized, for example by enlarging them.

This contact also potentially comprises one and/or another of the following features each considered independently of one another or in combination of one or several others:

- the contact comprises a connection portion extending longitudinally about a central axis, between a front end and a rear end, this connection portion comprising a tab extending between a fixed end joined to the connection portion and a free end, the attachment portion being situated between the fixed end of the tab and the front end of the connection portion;
- the first wall comprises two teeth and two cutouts separated by a wedge, each of the teeth extending respectively into a cutout;
- the wedge comprises a guide portion at an apex end, and a retention portion at the level of which the teeth are retained;
- each cutout is delimited laterally by two retaining edges which are essentially mutually parallel and inclined with respect to the edge of the first wall, at the level of which edge the cutout opens, and with respect to a direction of insertion of the tooth inserted into the corresponding cutout;
- the two respective retaining edges of a cutout form an acute angle with the two retaining edges of another cutout;
- at least one tooth comprises an aperture cut into the thickness of the strip.

According to another aspect, there is proposed a method for manufacturing an electrical contact for an electrical connector, wherein

- a blank is cut from at least one strip of electrically conducting material, this blank comprising a first contact wall and a second contact wall, with at least one cutout in the first wall and one tooth in the second wall, and
- the blank is bent in such a way that the first wall extends essentially in a first plane and the second wall extends essentially in a second plane distinct from the first plane, and in such a way as to bring one edge of the second wall, over at least one attachment portion, towards one edge of the first wall.

Furthermore, according to this method, the tooth is also bent with respect to the plane of the second wall so that the tooth becomes inserted in the cutout, when the edge of the second wall is brought towards the edge of the first wall, over at least the attachment portion.

This method also potentially comprises one and/or another of the following features each considered independently of one another or in combination of one or several others:

an aperture is cut into the thickness of the strip at the level of at least one tooth;

each tooth is deformed as it is inserted into a cutout in shear in a plane parallel to that of the first wall.

BRIEF DESCRIPTION OF THE DRAWINGS

Further features, objects and advantages of the female contact mentioned hereinabove will become apparent from reading the detailed description which will follow, and from studying the attached drawings, given by way of nonlimiting examples, and in which.

DETAILED DESCRIPTION

One example of embodiment of the female electrical contact 1 is described hereinbelow. In the present document, only one embodiment of a contact 1 for a female electrical connector is described by way of example, but the techniques of this disclosure can be used to create an electrical contact for a male electrical connector.

In this document, the terms "front", "rear", "above", "below", "upper", "lower", etc. are purely conventional and refer, where applicable, to the orientations as depicted in the figures.

In the figures, the same references denote elements that are identical or similar.

Figure 1:
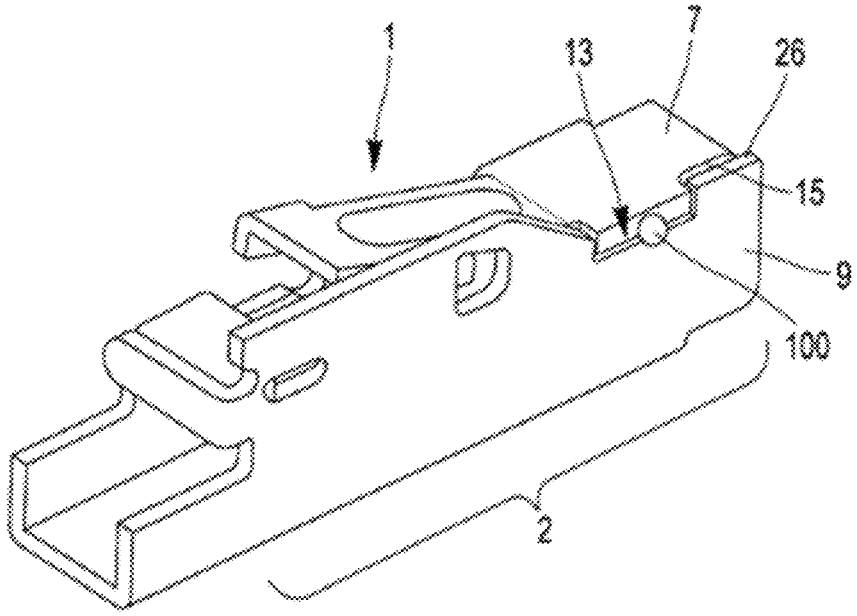
(PRIOR ART) FIG. 1
FIG. 1 is a schematic perspective depiction of a connection portion of one example of embodiment of a female contact according to the prior art.
Figure 2:
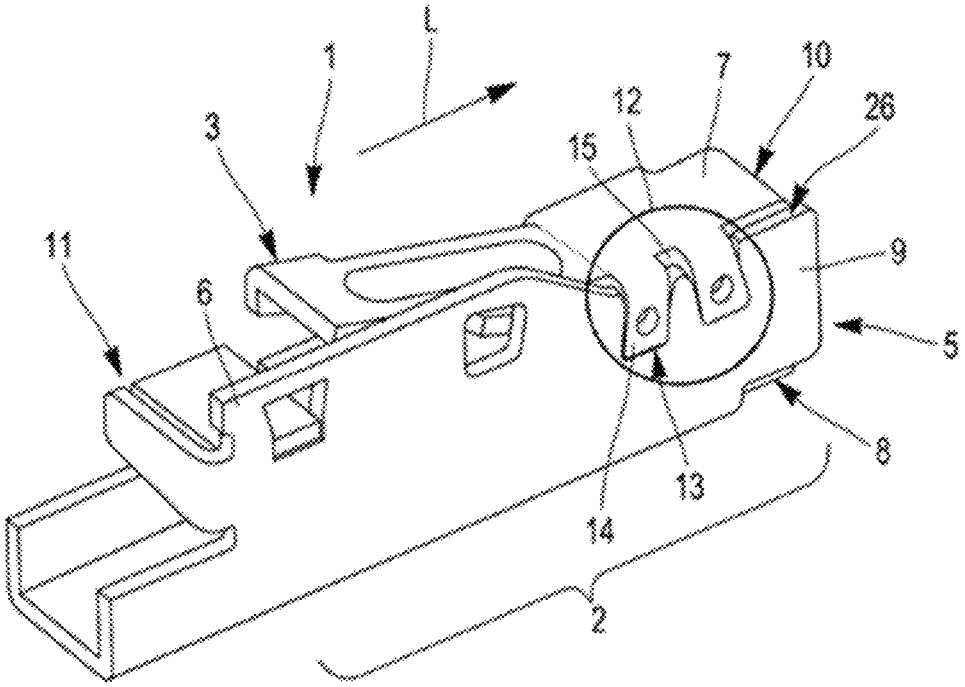
FIG. 2 is a schematic perspective depiction of a connection portion of one example of embodiment of a female contact according to the techniques of this disclosure.

The electrical contact 1 depicted in FIG. 2 is cut and bent from a strip of electrically conducting material. Only the connection portion 2 of this contact 1 is depicted in FIG. 2, but the contact also comprises a fixing portion to which, for example, a conducting wire is fixed in a known manner (for example by crimping or soldering).

This contact 1 is intended to be housed, in a known way, in a cavity of a connector housing (not depicted) molded from an electrically insulating material. The contact 1 is held and locked in its cavity using a tab 3.

The contact 1 extends in a longitudinal direction L which also corresponds to the direction of coupling of a male contact (not depicted) with the contact 1.

The connection portion 2 comprises a contact portion 5 proper to accept a tongue of a male contact, and an error-proofing rib 6. The error-proofing rib 6 is situated above the contact portion 5 and orients the contact 1 in its cavity.

The contact portion 5 defines a cage with an upper wall 7, a lower wall 8 and two lateral walls 9. The upper wall 7 extends in a plane essentially perpendicular to that of the lateral walls 9. It is also possible to define, on the connection portion 2, a front end 10 and a rear end 11, at the level of which the connection portion 2 is closed by its upper 7, lower 8 and lateral 9 walls.

Numerous and high stresses may be applied to the contact portion 5, notably via the various elements that interact with the cavity of the housing in which the contact 1 is housed (tab 3, error-proofing rib 6, male contact tongue, electrical wire acting on the fixing portion). It is therefore necessary for the contact portion 5 to be robust and closed reliably about a central axis parallel to the longitudinal direction L.

The contact 1 can be small in size and made from a thin strip. It is therefore important, in order to obtain the necessary robustness for the contact portion 5, to have particularly reliable means for closing the contact portion 5.

Specifically, for example, the dimensions of the contact portion 5 are tailored to accept male contact tongues having a cross section of which the longest dimension is 0.5 mm or less (with a thickness of 0.4 mm for example). For example, the exterior dimensions of the contact portion 5 are 0.9 mm in width (from one lateral wall 9 to the other) and 0.8 mm in height (from the upper wall 7 to the lower wall 8).

If the sheet metal has a thickness of 0.15 mm, the internal dimensions of the contact portion 5 are approximately 0.6 mm in width and 0.5 mm in height. These are mean values, the contacts 1 being manufactured to specific tolerance ranges.

As depicted in FIG. 2, the contact portion 5 comprises an attachment zone or portion 12 at the level of which particularly robust means of closing the contact portion 5 are provided.

Figure 3:
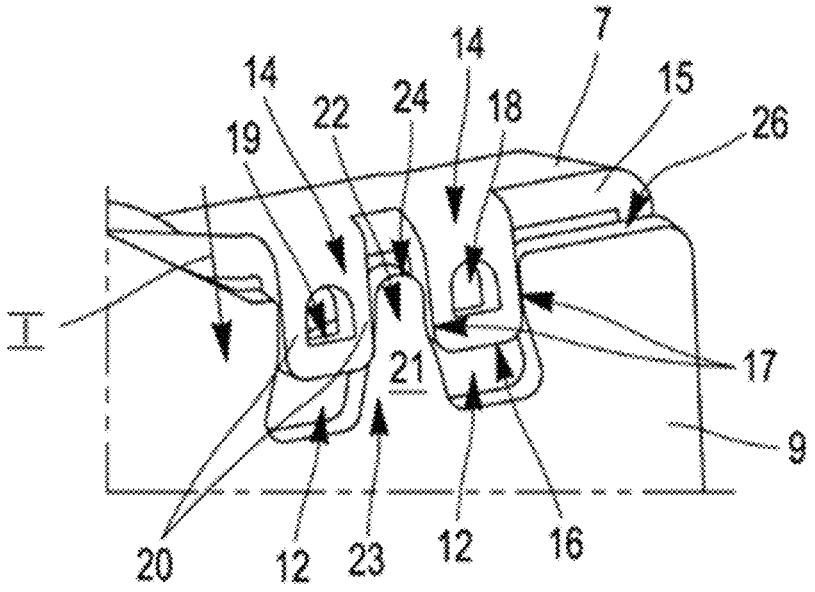
FIG. 3 is a schematic perspective depiction of the attachment portion of the contact depicted in FIG. 2, during a step of its method of manufacture.
Figure 4:
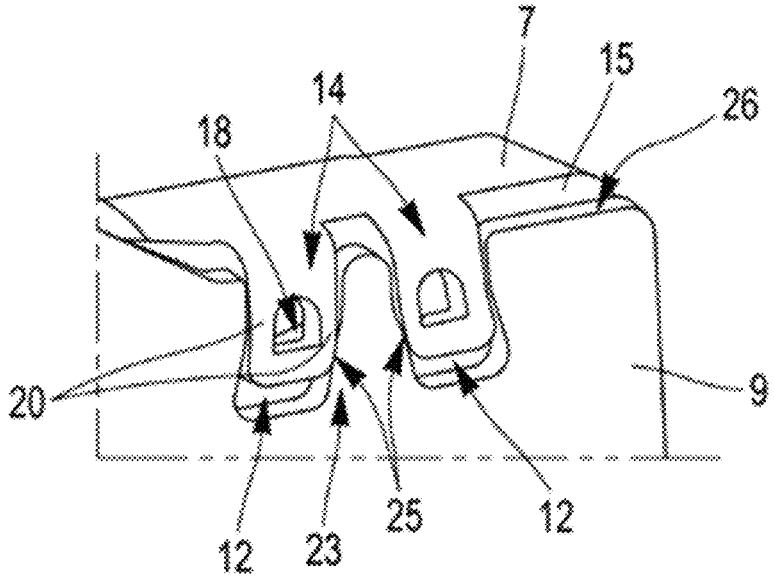
FIG. 4 is a schematic perspective depiction of the attachment portion of the contact depicted in FIG. 2, during a step of its method of manufacture, that is subsequent to the step illustrated in FIG. 3.
Figure 5:
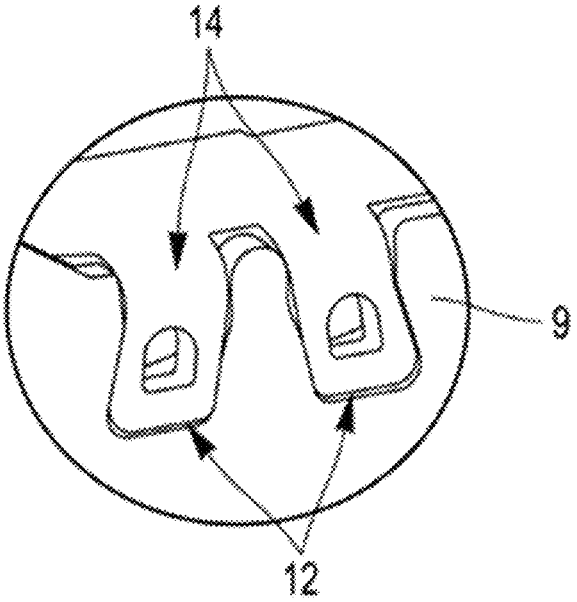
FIG. 5 is a schematic perspective depiction of the attachment portion of the contact depicted in FIG. 2, resulting from the implementation of the method of manufacture thereof.

As depicted in greater detail in FIGS. 3, 4 and 5, at the level of the attachment portion 12, one of the lateral walls 9 (namely the first wall using the terminology of the claims) comprises two cutouts 13 open onto one of its edges, and the upper wall 7 (namely the second wall according to the terminology of the claims) comprises two teeth 14 projecting from one of its edges. Each of the two teeth 14 is inserted forcibly into a cutout 13. As depicted in FIG. 5, when the contact is finished, each of the two teeth 14 extends in the plane of the lateral wall 9 in which the cutouts 13 are made.

Each of the two teeth 14 extends essentially longitudinally perpendicular to the edge 15 of the upper wall 7, from which they project. Each of the two teeth 14 comprises, between this edge 15 and its free end 16, two mutually parallel edges 17. Each of the two teeth 14 also comprises an aperture 18 cut into the thickness of the strip. This aperture 18 comprises a straight edge 19 situated towards the free end 16 of the tooth 14 in which the aperture 18 is cut. The two ends of this straight edge 19 are joined together by a U-shaped edge. Each tooth 14 thus has a band of more easily deformable material, forming two arms 20 situated each on a respective side of an aperture 18, relative to the direction of insertion I of the tooth 14 into its cutout 13.

The two cutouts 13 are separated by a wedge 21. This wedge 21 comprises a guide portion 22 and a retention portion 23. The guide portion 22 is situated essentially at the level of the apex end of the wedge 21. It comprises a rounded vertex 24 facilitating insertion of the teeth 14 into their respective cutout 13. It also comprises two essentially parallel edges extending downwards from the vertex 24 towards the retention portion 23. The edge of the wedge 21, at the level of the rounded vertex 24 and of the parallel edges, therefore exhibits, when viewed in elevation, a U shape. This edge is continued, on either side of the wedge 21, at the level of its retention portion 23, by two retaining edges 25 which diverge from one another from the point at which they meet the parallel edges, towards the base of the wedge 21.

Each cutout 13 is laterally delimited by two edges. These edges are essentially mutually parallel. Near the opening of the cutout 13 onto the upper edge 26 of the lateral wall 9 (namely essentially at the same level as the apex end of the wedge 21), these two edges are essentially perpendicular to this upper edge 26.

As depicted in FIG. 3, during the method of manufacturing the contact 1, the upper wall 7 is bent over by bringing the edge 15 of the upper wall towards the upper edge 26 of the lateral wall, in order to close up the connection portion 2. During this operation, each of the two teeth 14, which have previously been bent over perpendicular to the lateral wall 9, towards same, becomes inserted in a cutout 13. At the start of this initial insertion phase, the longitudinal edges 17 of each tooth 14 are guided by the rounded vertex 24 of the wedge 21, then the edges of the guide portion 22 of the wedge 21, as well as the corresponding edges situated in the vicinity of the opening of each cutout 13. At the start of insertion of the teeth 14 into the cutouts 13, the respective edges of each of the teeth 14, of the wedge 21 and of each of the cutouts 13 are essentially parallel to the direction of insertion I of the teeth 14 into the cutouts 13.

As depicted in FIG. 4, after the initial phase of insertion of the teeth 14 into the cutouts 13, the teeth 14 undergo deformation (in shear essentially in a plane parallel to that of the lateral wall 9) which tends to part them from one another. Specifically, at the level corresponding to the retention portion 23 of the wedge 21, the retaining edges 25 are essentially mutually parallel but inclined with respect to the upper edge 26 of the lateral wall and the two respective retaining edges 25 of one cutout 13 form an acute angle with the two retaining edges 25 of the next cutout 13. The arms 20, which were longitudinally essentially parallel to the direction of insertion I during the initial insertion phase, are directed along the retaining edges 25 and thus deformed to adapt to the shape of the cutout 13. The deformation of the arms 20 is facilitated by the presence of the apertures 18.

Once the forcible insertion of each of the teeth 14 into its respective cutout 13 is completed, the arms 20 are pressed firmly against the edges of this cutout and, notably, the retaining edges 25. The teeth 14 are thus wedged in place. Furthermore, because of the different orientations of the respective edges of the cutouts 13 and of the teeth 14, on either side of the wedge 21, increased resistance to any potential force that might tend to lift the upper wall 7 and move it away from the lateral wall 9 is obtained.

What is claimed is:

1. A method for manufacturing an electrical contact for an electrical connector, comprising:

cutting a blank from at least one strip of electrically conducting material, the blank comprising a first contact wall and a second contact wall, with at least one cutout in the first wall and one tooth in the second wall, the cutout including an opening on an edge of the first wall, the tooth including a free end;

bending the blank in such a way that the first wall extends essentially in a first plane and the second wall extends essentially in a second plane distinct from the first plane, and in such a way as to bring one edge of the second wall, over at least one attachment portion, towards the edge of the first wall;

bending the tooth with respect to the plane of the second wall; and inserting the free end of the tooth into the opening so that the tooth becomes forcibly inserted in the cutout, in a direction of insertion parallel to the first wall, when the edge of the second wall is brought towards the edge of the first wall, over at least the attachment portion.

2. The method of claim 1, further comprising:

cutting an aperture into a thickness of the strip.

3. The method of claim 2, wherein cutting the aperture comprises:

cutting the aperture into the thickness of the strip at a level of at least one tooth.

4. The method of claim 1, further comprising:

deforming each tooth as it is inserted into the cutout in shear in a plane parallel to that of the first wall.

5. The method of claim 1, further comprising:

forming a connection portion extending longitudinally about a central axis, between a front end and a rear end, the connection portion comprising a tab extending between a fixed end joined to the connection portion and the free end, the attachment portion being situated between the fixed end of the tab and the front end of the connection portion.

6. The method of claim 1, wherein the first wall comprises two cutouts separated by a wedge, wherein the second wall comprises two teeth, and wherein each of the teeth extend respectively into a cutout.

7. The method of claim 6, wherein the wedge comprises a guide portion at an apex end, and a retention portion at a level of which the teeth are retained.

8. The method of claim 1, wherein each cutout is delimited laterally by two retaining edges that are mutually parallel and inclined with respect to the edge of the first wall, at a level of which edge the cutout opens, and with respect to a direction of insertion of the tooth inserted into the cutout.

9. The method of claim 8, wherein two respective retaining edges of a cutout form an acute angle with two retaining edges of another cutout.

* * * * *